US012331643B2

(12) United States Patent
Payne et al.

(10) Patent No.: US 12,331,643 B2
(45) Date of Patent: Jun. 17, 2025

(54) MINE DRILL MODULE INCLUDING GRIPPER WITH FOLDING ARMS

(71) Applicant: J.H. FLETCHER & CO., Huntington, WV (US)

(72) Inventors: Nathan U. Payne, South Point, OH (US); Marc D. Endicott, Kenova, WV (US); Gregory E. Hinshaw, Proctorville, OH (US); Timothy D. Burgess, South Point, OH (US)

(73) Assignee: J.H. FLETCHER & CO., Huntington, WV (US)

( * ) Notice: Subject to any disclaimer, the term of this patent is extended or adjusted under 35 U.S.C. 154(b) by 137 days.

(21) Appl. No.: 18/011,320

(22) PCT Filed: Jun. 25, 2021

(86) PCT No.: PCT/US2021/039085
§ 371 (c)(1),
(2) Date: Dec. 19, 2022

(87) PCT Pub. No.: WO2021/263102
PCT Pub. Date: Dec. 30, 2021

(65) Prior Publication Data

US 2023/0304404 A1 Sep. 28, 2023

Related U.S. Application Data

(60) Provisional application No. 63/044,425, filed on Jun. 26, 2020.

(51) Int. Cl.
*E21D 20/00* (2006.01)

(52) U.S. Cl.
CPC ..... *E21D 20/006* (2013.01)

(58) Field of Classification Search
CPC ..... E21D 20/00; E21D 20/003; E21D 20/006
See application file for complete search history.

(56) References Cited

U.S. PATENT DOCUMENTS

| | | | | |
|---|---|---|---|---|
| 3,902,561 A | | 9/1975 | Friberg | |
| 5,114,279 A | * | 5/1992 | Bjerngren | E21D 20/006 405/303 |
| 5,556,235 A | * | 9/1996 | Morrison | E21D 20/006 81/55 |

(Continued)

FOREIGN PATENT DOCUMENTS

| | | |
|---|---|---|
| AU | 2016213888 A1 | 9/2016 |
| WO | 2014035316 A1 | 3/2014 |
| WO | 2016094022 A1 | 6/2016 |

*Primary Examiner* — Frederick L Lagman
(74) *Attorney, Agent, or Firm* — Dickinson Wright PLLC; Andrew D. Dorisio

(57) ABSTRACT

An apparatus is for installing support for a surface of a mine passage, such as a mine roof, using an object, such as a roof bolt. The apparatus includes a driver adapted to advance toward the surface for driving the object into the surface. A gripper includes first and second arms for gripping the object in a deployed position, such as upper and lower arms. The arms are linked such that engagement by one of the arms with the driver during advance causes the arms to retract towards each other (downwardly, for example, in the case of the upper arm, and upwardly, for example, in the case of the lower arm). Related methods are also disclosed.

17 Claims, 7 Drawing Sheets

(56) References Cited

U.S. PATENT DOCUMENTS

| | | | | |
|---|---|---|---|---|
| 6,135,674 | A | 10/2000 | Neilson | |
| 6,598,309 | B1 * | 7/2003 | Coombs | E21D 20/006 33/645 |
| 7,607,866 | B2 * | 10/2009 | Eddowes | E21B 19/16 405/259.1 |
| 8,297,886 | B2 * | 10/2012 | Eddowes | E21B 19/20 405/259.1 |
| 8,956,082 | B2 * | 2/2015 | Nelson | E21B 19/086 405/259.1 |
| 2018/0126563 | A1 | 5/2018 | Magnuson | |
| 2019/0078400 | A1 | 3/2019 | Simanjuntak | |
| 2019/0284885 | A1 | 9/2019 | Soyland | |

* cited by examiner

MINE DRILL MODULE INCLUDING GRIPPER WITH FOLDING ARMS

This application claims the benefit of U.S. Provisional Patent App. Ser. No. 63/044,425, filed Jun. 26, 2020, the disclosure of which is incorporated herein by reference.

TECHNICAL FIELD

This disclosure is directed to the mining arts, and more specifically, to a gripper with folding arms for a mine drill module.

BACKGROUND

In the course of installing an object, such as an anchor or bolt, in a borehole formed in a surface of an underground mine passage, such as the roof, it is typically necessary to retrieve the bolt from a holder, which may take the form of a rotatable carousel. It is known to retrieve the anchor using a gripper, at the end of an arm. This arm may pivot from a position for engaging the bolt in the carousel to repositioning the retrieved bolt in alignment with a drill head for driving the bolt into a previously formed bolt hole (see, e.g., commonly owned U.S. Pat. No. 7,428,937, the disclosure of which is incorporated herein by reference).

Past approaches require releasing the bolt and moving the gripper/arm from the path of the drill/bolt head prior to the advance. This takes extra time to accomplish, and also requires further intervention to stabilize the bolt prior to and during the advance. Manual intervention is also to be avoided as much as possible in view of the harsh and cramped operating conditions in a typical underground mine.

Accordingly, an objective of the present disclosure is to provide an improved gripper/arm than overcomes the foregoing limitations, and perhaps others that have yet to be discovered.

SUMMARY

According to a first aspect of the disclosure, an apparatus for inserting an object into a borehole in a mine passage is provided. The apparatus includes a driver adapted to advance toward the surface for driving the object into the borehole. A gripper includes first and second arms for gripping the object in a deployed position. The first and second arms are linked such that engagement by one of the first and second arms with the driver during advance causes the first arm to retract, such as by folding, toward the second arm and the second arm to retract toward the first arm, which also may be as a result of folding.

In one embodiment, the first and second arms are linked by a linkage. The first arm may comprise an upper arm adapted for pivoting downwardly during retraction. The second arm may comprise a lower arm adapted for pivoting upwardly during retraction. Each of the first and second arms may include a pair of jaws for selectively gripping the object. A spring is provided for biasing one of the first or second arms toward the deployed position.

A driver is mounted for movement along a mast connected to a drill module to which the gripper is mounted. A drill module is mounted for moving the driver from a home position into alignment with the borehole. A stop in a return path is for engaging one of the first and second arms to cause retraction.

The apparatus may further include a magazine for holding at least one object in a position for being gripped by the gripper. The magazine may comprise a rotary carousel. The carousel may hold a plurality of the objects.

According to a further aspect of the disclosure, an apparatus is provided for assisting in inserting an object into a borehole in a mine passage. The apparatus includes a gripper with at least one arm having jaws for gripping the object in a deployed position. The at least one arm is adapted to move away from the borehole to a retracted position.

In one embodiment, a second arm is adapted to move toward the borehole to a retracted position. The first and second arms may be linked by a linkage. The first arm may comprise an upper arm adapted for pivoting downwardly during retraction. The second arm may comprise a lower arm adapted for pivoting upwardly during retraction. Each of the first and second arms may include a pair of jaws for selectively gripping the object. A spring is provided for biasing one of the first or second arms toward the deployed position. A driver may be adapted to advance toward the surface such that engagement between the second and the driver during the advance causes the first and second arms to move to the retracted position.

Still further, the disclosure may relate to a method of inserting an object into a borehole in a mine passage. The method comprises advancing a driver for driving the object into the borehole into engagement with a first arm of a gripper for causing the first arm to move from a deployed position in a direction away from the borehole to a withdrawn position. In one example, the first arm is linked to a second arm, such that the method includes the step of concurrently moving the second arm from a deployed position to a withdrawn position. The first arm may comprise an upper arm, and the causing step causes the upper arm to move downwardly.

BRIEF DESCRIPTION OF THE DRAWING FIGURES

The above and further advantages of the disclosed inventions may be better understood by referring to the following description in conjunction with the accompanying drawings in which.

Figure 1:
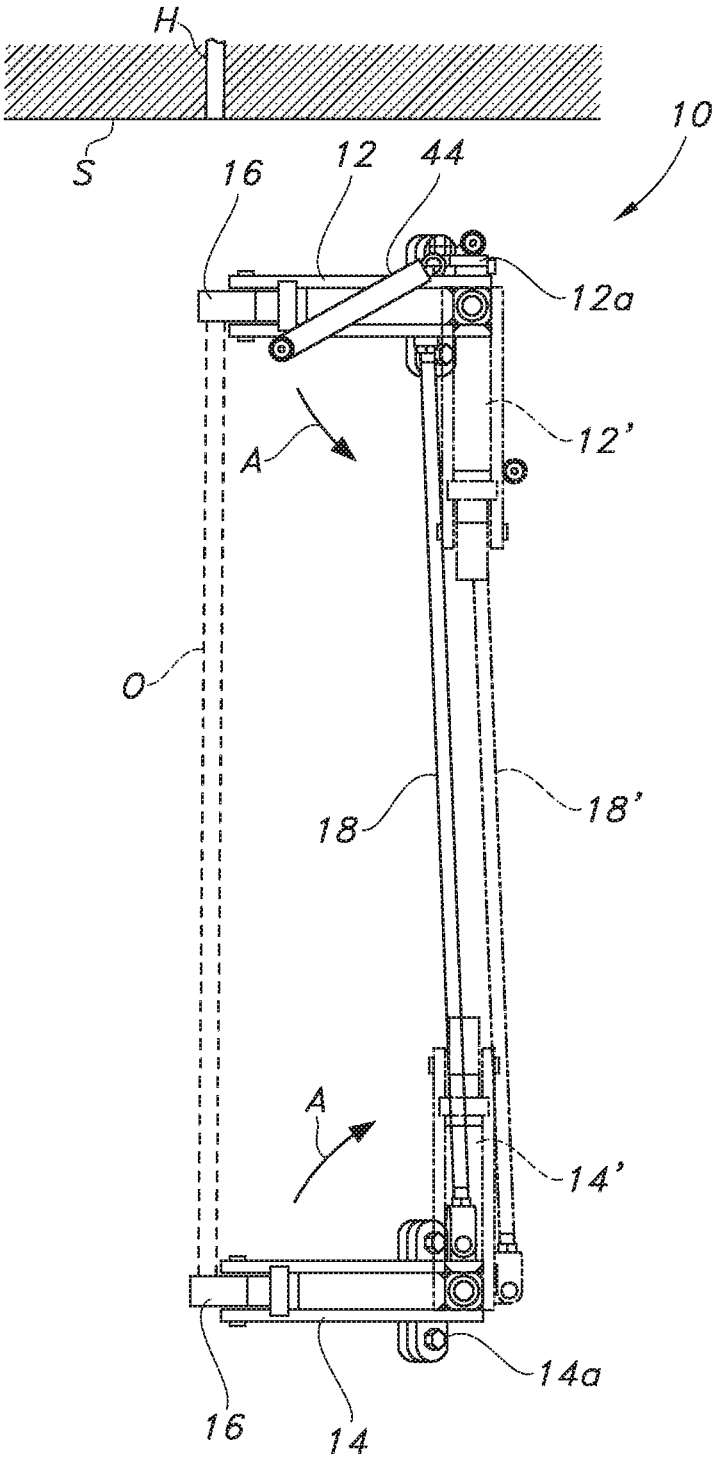
FIG. 1 is a side elevational view of a gripper according to one aspect of the disclosure.

The dimensions of some of the elements may be exaggerated relative to other elements for clarity or several physical components may be included in one functional block or element. Further, sometimes reference numerals may be repeated among the drawings to indicate corresponding or analogous elements. Moreover, some of the parts depicted in the drawings may be combined into a single function.

DETAILED DESCRIPTION

In the following detailed description, numerous specific details are set forth to provide a thorough understanding of the present invention. The disclosed embodiments may be practiced without these specific details. In other instances, well-known methods, procedures, components, or structures may not be described in full detail so as not to obscure the inventive concepts. The invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein are for the purpose of description and should not be regarded as limiting. Certain features of the invention that are, for clarity, described in the context of separate embodiments, may also be provided in combination in a single embodiment. Conversely, various features of the invention that are, for brevity, described in the context of a single embodiment, may also be provided separately or in any suitable sub-combination.

Figure 1A:
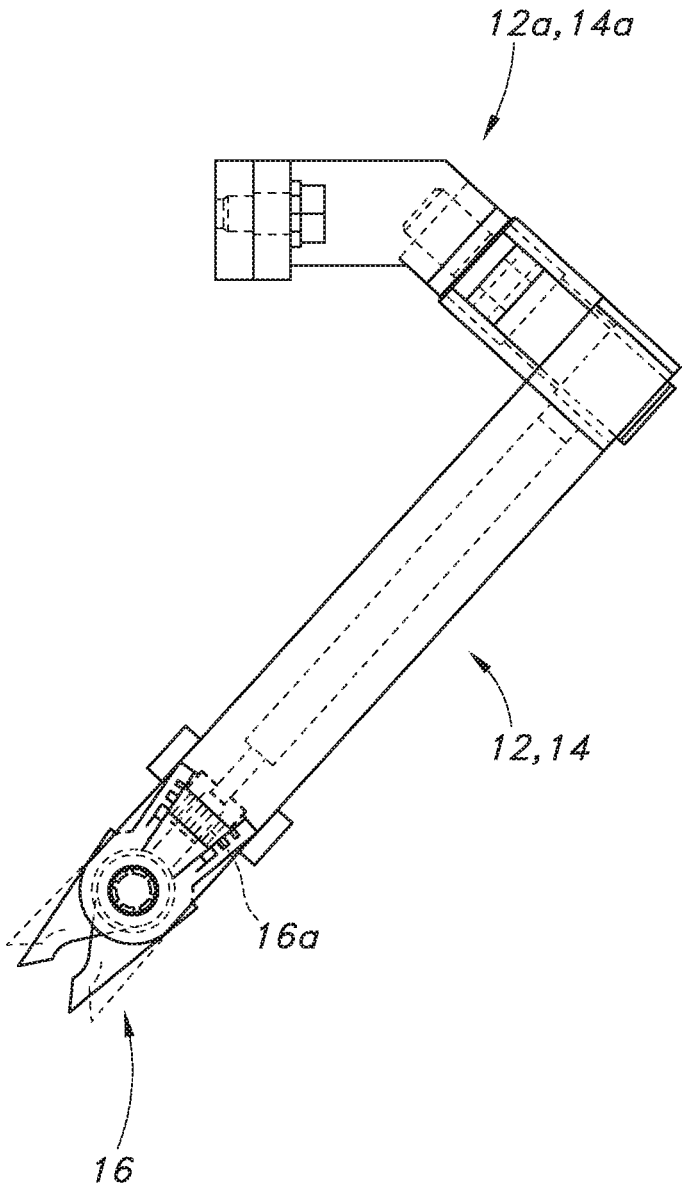
FIG. 1A is a top view of a jaw assembly forming part of the gripper.

In accordance with FIG. 1, a bolt gripper 10 is shown, apart from a bolting module 20, which is shown in FIGS. 2-5 and outlined further in the following description. The gripper 10 includes first and second arms, such as upper and lower arms 12, 14, which project outwardly from a common (e.g., vertical) axis in use in the illustrated example. Each arm 12, 14 is movably mounted at one end to a support 12*a*, 14*a* (see FIG. 1A) so as to allow rotation relative to a transverse axis, and the opposite end includes jaws 16 adapted to clamp onto a cylindrical object O, such as an elongated bolt, for being advanced or driven into a borehole H in a surface S of a mine passage. The jaws 16 may normally bias to a closed position, such as by a compression spring 16*a*, as also shown in FIG. 1A.

The mounting of the arms 12, 14 is such that the movement from a deployed position to a retracted position is such that the arms move toward each other. For instance, in the illustrated configuration where the axis is vertical, the lower arm 14 is adapted to rotate upwardly, and the upper arm 12 is adapted to rotate downwardly. Again, however, different orientations may dictate a different arrangement.

The arms 12, 14 may be interconnected to achieve the relative movement in concert. In the illustrated embodiment, a linkage 18 is provided for connecting the arms 12, 14. Consequently, when the lower arm 14 is rotated upwardly in the illustrated version, the linkage 18 causes the upper arm 12 to rotate downwardly in concert, as shown in the phantom view of arms 12', 14' and linkage 18' in FIG. 1, and further indicated by action arrows A. The rotation of the arm 12 away from the borehole, or downwardly in the case of an upper arm as shown, is desirable in the confines of a mine passage, where overhead space is typically quite limited.

Figure 2:
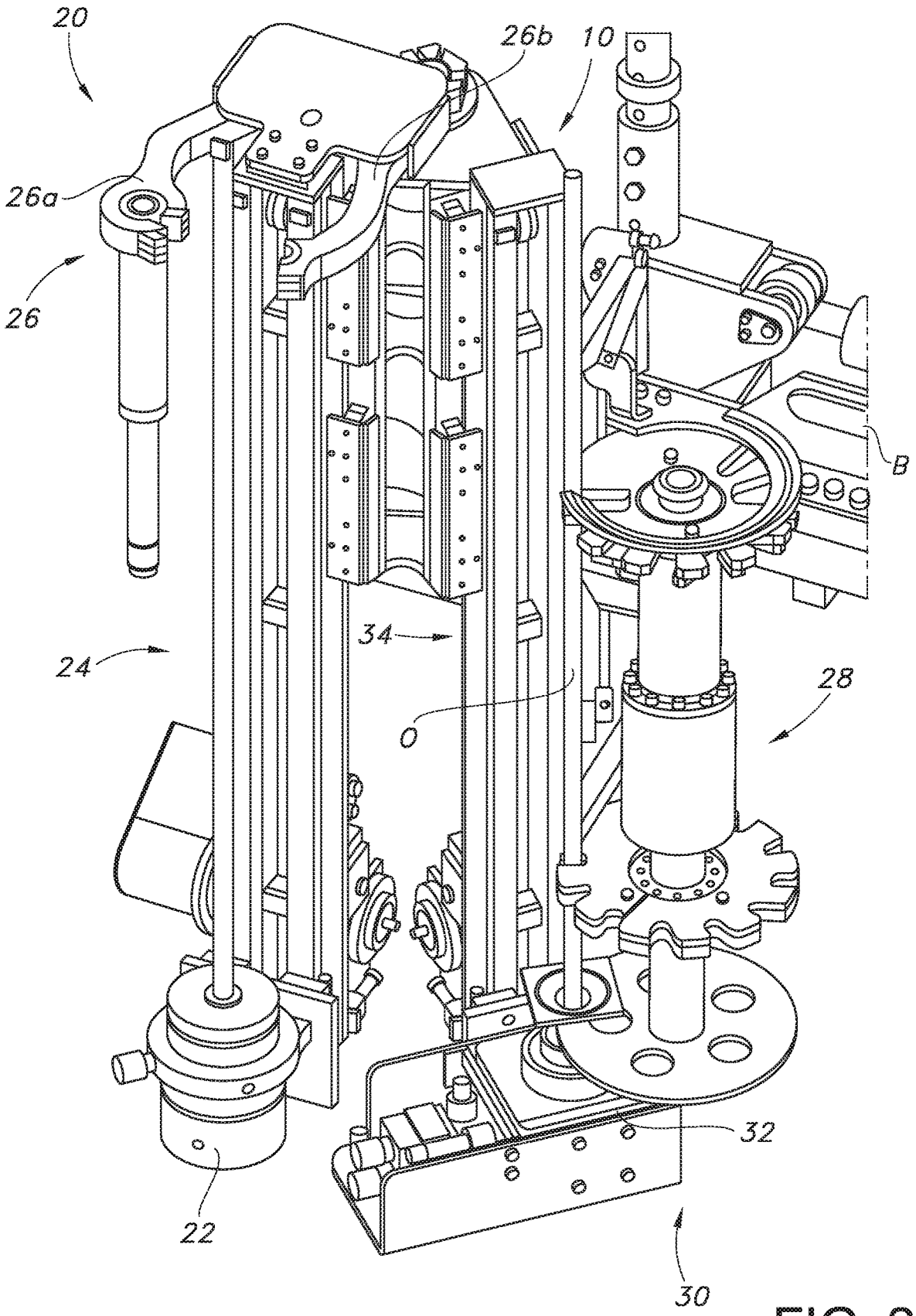
FIGS. 2-5 are partially cutaway progressive front perspective views of a mine bolting module including a gripper according to the disclosure.

FIG. 2 illustrates the gripper 10 connected to and forming part of a drill/bolt module 20, sometimes referred to as a "rig." This module 20 comprises a driver in the form of a rotary drill head 22 adapted to be driven vertically along a mast 24 for driving a drilling element or steel S aligned with a drilling axis into a surface of the mine passage to form a borehole. The mast 24 includes a guide 26 at an upper end with jaws 26*a*, 26*b* adapted to close over and guide an object, such as a bolt or anchor, into a borehole formed in an adjacent surface of a mine passage. The module 20 also includes a magazine 28, which may be in the form of a rotary carousel, but could be a linear or stationary form as well, and is considered optional (as the objects could instead be manually loaded into the gripper 10).

Figure 3:
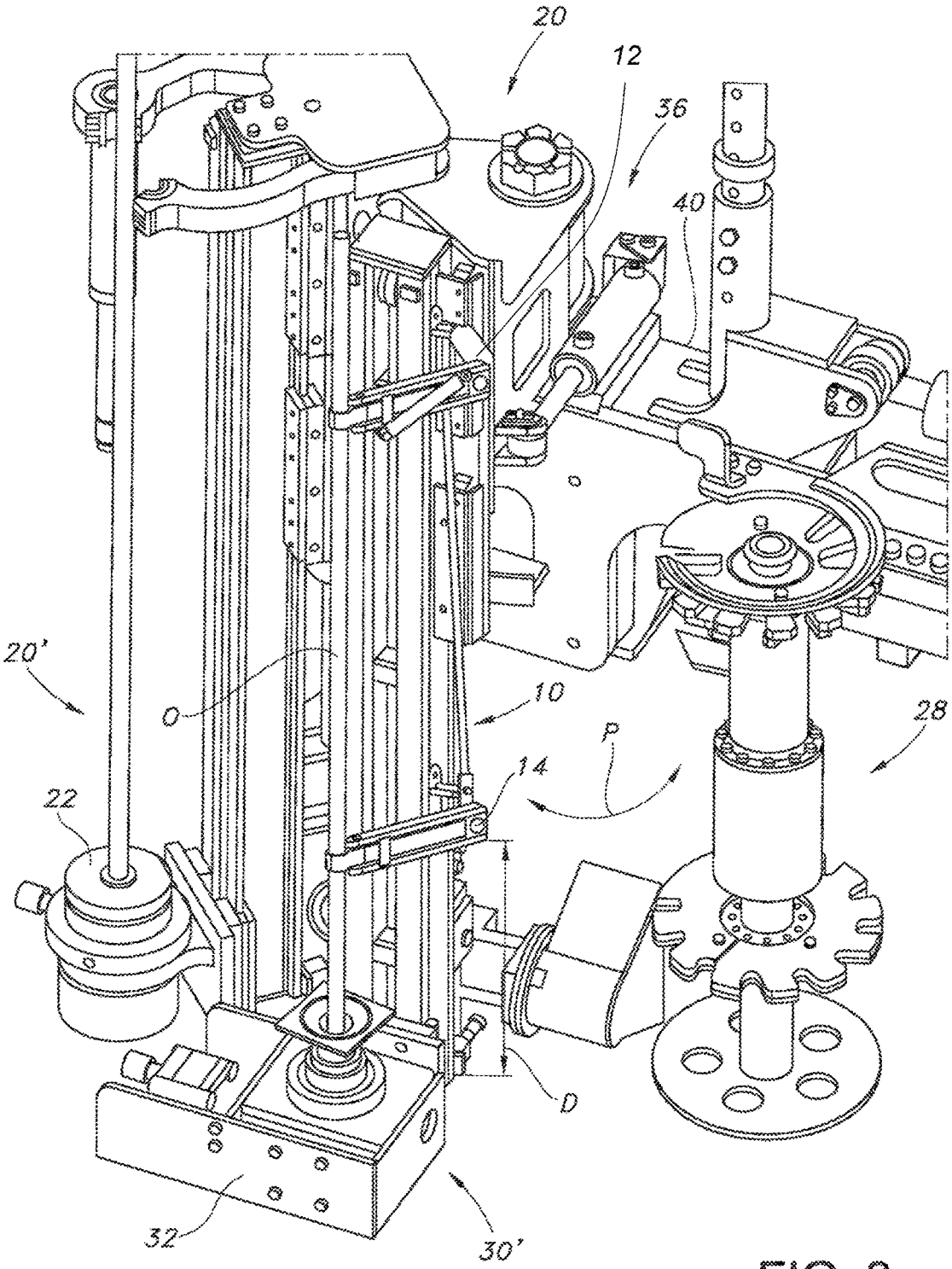
Figure 4:
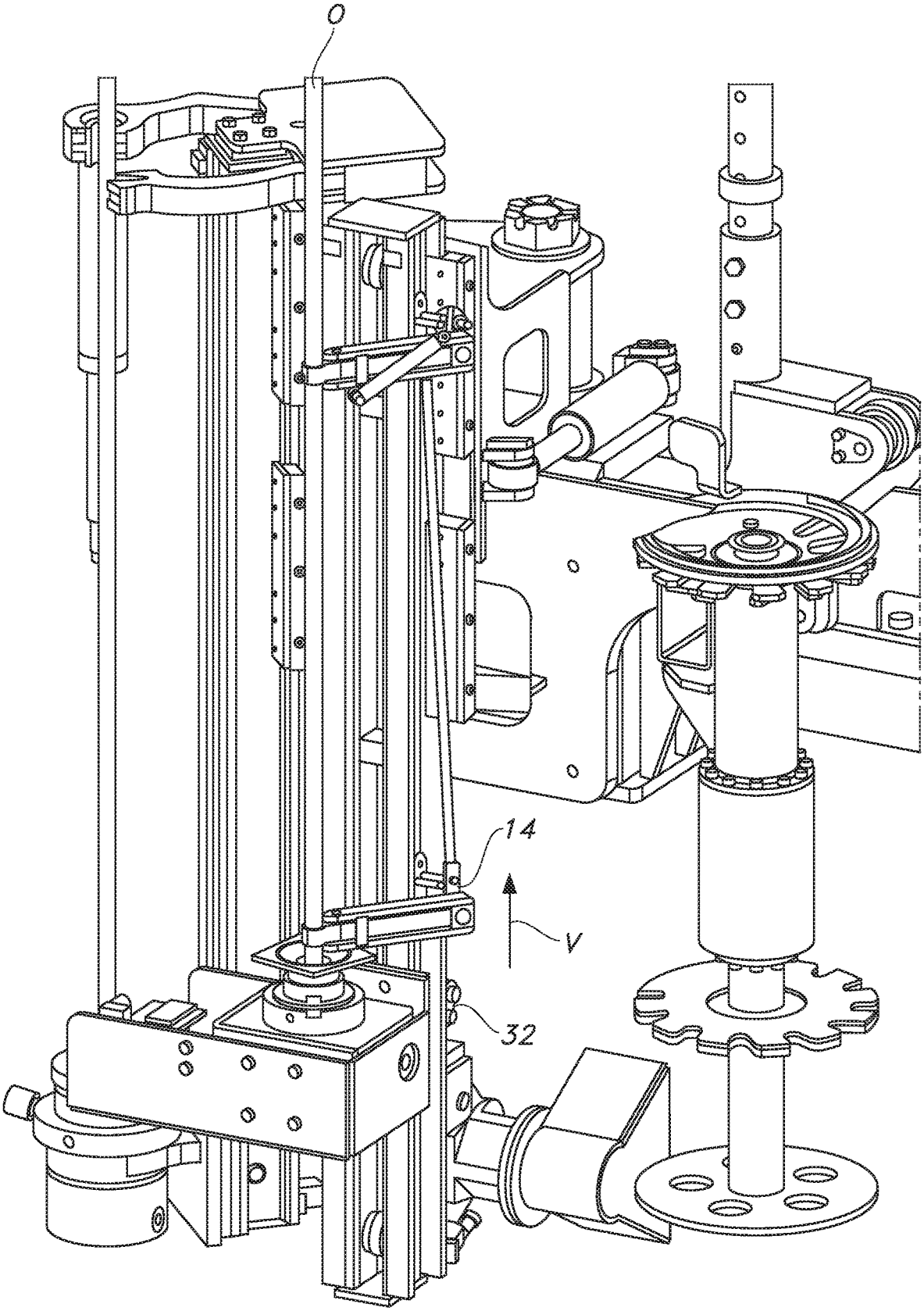

As perhaps best understood by comparing FIGS. 2, 3, and 4, the gripper 10 is provided on an auxiliary ("bolting") module 30. This auxiliary module 30 includes a bolt driver 32 and a second mast 34, and is nominally located between the drill head 22 and the magazine 28. The auxiliary module 30 is adapted for rotating in a generally curved or arcuate path P. This movement may be achieved using an actuator 36, such as a hydraulic cylinder. The movement may be from a withdrawn position adjacent to the magazine 28, to a deployed position aligning the driver 32 with the drilling axis coincident with a previously formed borehole, such as using main drill module 20.

In the first position, as shown in FIG. 2, the gripper 10 pivots such that the jaws 16 of each arm 12, 14 open to clamp onto an object O held by the magazine 28, such as a bolt. The jaws 16 may then securely grip the object O. This may occur automatically in the case of spring-biased jaws 16 such as those shown in FIG. 1A.

The auxiliary module 30 then moves into alignment with the drilling axis. As can be appreciated, this switchover from a drilling mode to an alternative (bolting) mode requires first moving the other drill head 22 and mast 24 from a position in alignment with the drilling axis to a withdrawn position. This may be done by the actuator 36 in cases where the modules 20, 30 are supported by a common support 38, which may be pivotably mounted to a base 40 (which in turn may be connected by way of a boom B to a vehicle (not shown), thereby allowing for the modules 20, 30 to be raised, lowered, and moved about).

Figure 5:
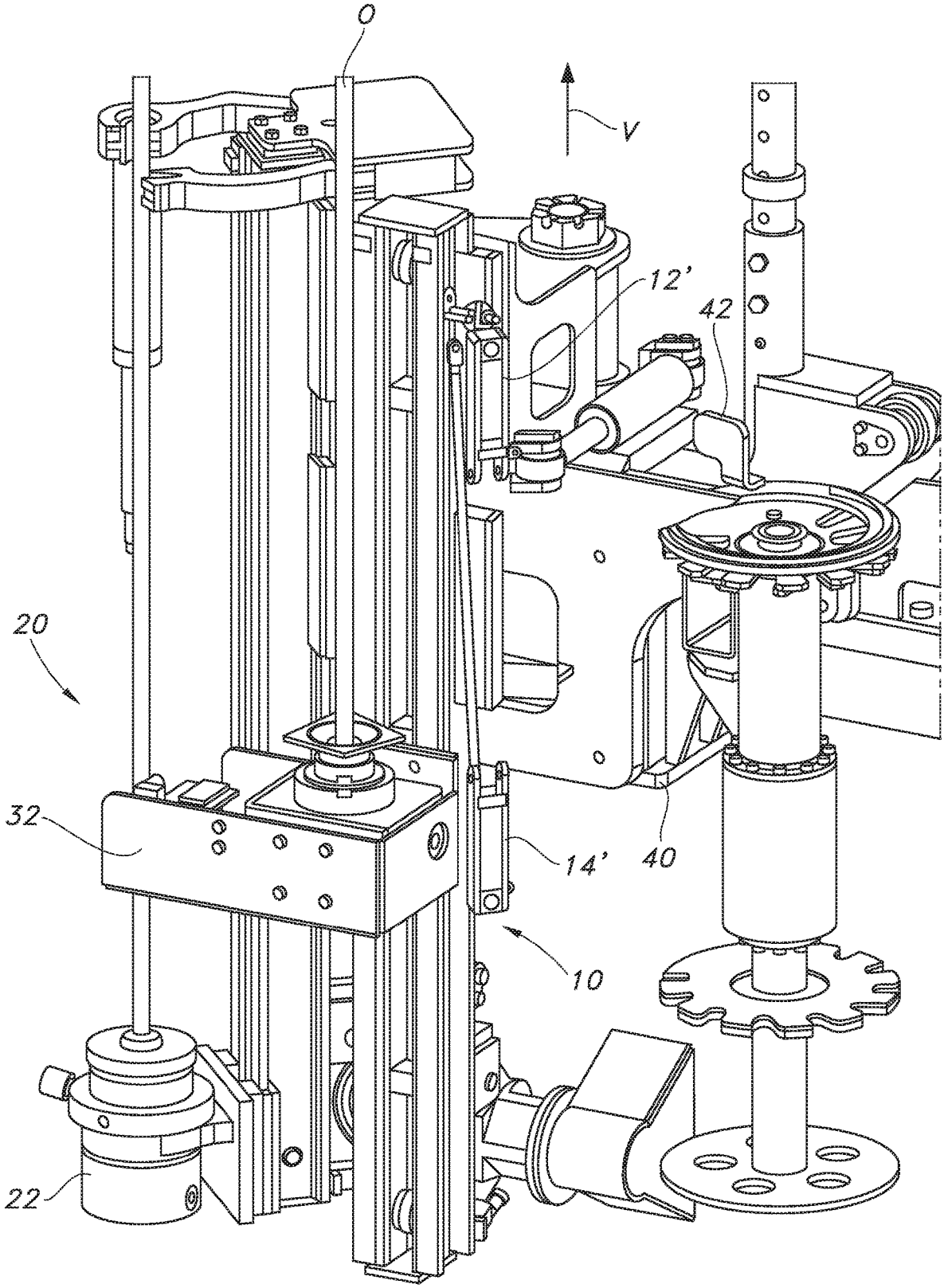

Turning now to FIGS. 4 and 5, it can be understood that, as the driver 32 of the auxiliary module 30 is driven vertically (arrow V) and advanced along the mast 34 to insert the object O into the previously formed borehole, contact is eventually made with the underside of the lower arm 14. As a result of the pivotable mounting, this causes the lower arm 14 to pivot from a deployed position upwardly and the jaws 16 to release from the object. The linkage 18 then pulls downwardly on the upper arm 12 as a result of the upward movement of lower arm 14, which moves it from the deployed position, in a direction away from the borehole, toward a retracted or withdrawn position, which similarly releases the jaws of the upper arm 12 from engagement with the object O.

The distance D between the point of engagement of the driver 32 with the lower arm 14 along the path of travel may be strategically designed such that the distal end of the object O is located at least partially in the borehole prior to contact being made for folding the arms 12, 14. This helps to ensure proper insertion of the object, even when the arms 12, 14 are withdrawn, and eliminates the need for added guidance as the advance is continued.

Figure 5A:
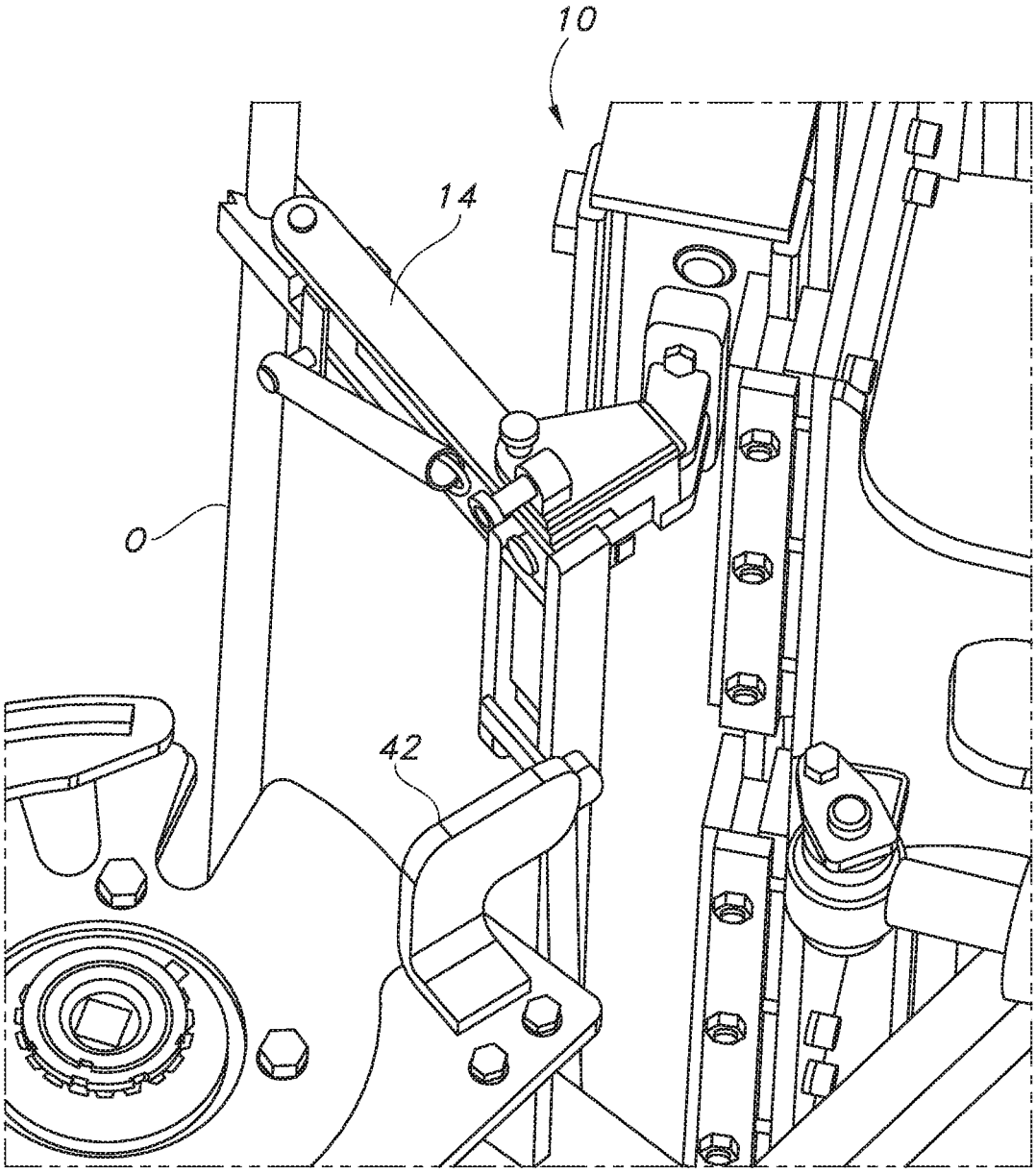
FIG. 5A is a partially cutaway rear perspective view of the mine bolting module.

In the case where the object O is an anchor or bolt, it may be rotated for a time post-insertion to ensure proper mixing of any grout or adhesive present in the borehole to ensure proper anchoring (but other anchors exist, including expansion shell type, friction type bolts called split sets, or post expanding bolts called "Swellex"). The driver 32 may then be lowered, and the auxiliary module 30 returned to a position withdrawn from alignment with the drilling axis for gripping an additional object from the magazine 28. As perhaps best understood from FIGS. 5 and 5A, a stop 42 may be located the return path of the gripper 10 for engaging the still folded or withdrawn upper arm 12. As the gripper 10 is pivoted to a home position for gripping another object, engagement with this stop 42 causes the upper arm 12 to pivot upwardly to the deployed position. Concurrently or simultaneously, as a consequence of the connection with linkage 18, the lower arm 14 also assumes the deployed position. As perhaps best understood from FIG. 1, a spring 44 connected to the upper arm 12 and the associated support 12*a* may also help urge it to the deployed position.

Upon completion of a further borehole at a different location by the main module 20, and the sequence described above for gripping an object and releasing it is repeated as necessary or desired to ensure proper support is achieved.

It can be appreciated that use of the disclosed gripper 10 is not limited to the exact arrangement shown. For example, the gripper 10 could be used for delivering an object in the form of a drilling element or steel to a drill head 22 for drilling into the surface of the mine passage to form a borehole. This surface could also be any surface of the mine passage other than the roof, for example, the sidewall or rib of the mine passage, and at any desired angular orientation. A particular example of such use would be in connection with a so-called "jumbo" drill for drilling into a sidewall of a mine tunnel for purposes of installing blast charges.

Summarizing the disclosure, a gripper 10 is provided for gripping an object O, such as a roof bolt, for delivery to a borehole. The gripper 10 includes arms 12, 14 with gripping jaws 16 that automatically secure and release from the object, such as by spring action. As the result of linked condition created by linkage 18, the arms 12, 14 are adapted to automatically fold in a concert during the installation of the object in the borehole by the drill head. This avoids the need for removing the gripper 10 from the path of the bolt head as it advances, and results in a highly automated and more efficient arrangement. The strategic positioning of the arms 12, 14 also may ensure that a distal end of the object is at least partially in the borehole prior to the arms releasing from the object, which ensures reliability and avoids the need for manual intervention.

This disclosure may be considered to relate to the following items:

1. An apparatus for inserting an object into a borehole in a mine passage, comprising:
   a driver adapted to advance toward the surface for driving the object into the borehole; and
   a gripper including first and second arms for gripping the object in a deployed position, the first and second arms being linked such that engagement by one of the first and second arms with the driver during advance causes the first arm to retract toward the second arm and the second arm to retract toward the first arm.
2. The apparatus of item 1, wherein the first and second arms are linked by a linkage.
3. The apparatus of item 1 or item 2, wherein each of the first and second arms includes a pair of jaws.
4. The apparatus of any of items 1-3, wherein the driver is mounted for movement along a mast connected to a drill module to which the gripper is mounted.
5. The apparatus of item 4, wherein the drill module is mounted for moving the driver from a home position into alignment with the borehole, and further including a stop in a return path for engaging one of the first and second arms to cause retraction.
6. The apparatus of any of items 1-5, further including a spring for biasing one of the first or second arms toward the deployed position.
7. The apparatus of any of items 1-6, further including a magazine for holding a plurality of the objects in a position for being gripped by the gripper.
8. The apparatus of item 7, wherein the magazine comprises a rotary carousel.
9. The apparatus of any of items 1-8, wherein first arm comprises an upper arm adapted for pivoting downwardly during retraction and the second arm comprises a lower arm adapted for pivoting upwardly during retraction.
10. An apparatus for assisting in inserting an object into a borehole in a mine passage, comprising:
    a gripper including at least one arm having jaws for gripping the object in a deployed position, the at least one arm adapted to move away from the borehole to a retracted position.
11. The apparatus of item 10, further including a second arm adapted to move toward the borehole to a retracted position.
12. The apparatus of item 11, wherein the first and second arms are linked by a linkage.
13. The apparatus of item 11, wherein each of the first and second arms includes a pair of jaws.
14. The apparatus of item 11, further including a driver adapted to advance toward the surface such that engagement between the second and the driver during the advance causes the first and second arms to move to the retracted position.
15. The apparatus of item 11, further including a spring for biasing one of the first or second arms toward the deployed position.
16. The apparatus of any of items 10-15, wherein a driver is mounted for movement along a mast connected to a drill module to which the gripper is mounted.
17. The apparatus of item 16, wherein the drill module is mounted for moving the driver from a home position into alignment with the borehole, and further including a stop in a return path for engaging one of the first and second arms to cause retraction.
18. The apparatus of any of items 10-17, further including a magazine for holding one or more of the objects in a position for being gripped by the gripper.
19. The apparatus of item 18, wherein the magazine comprises a rotary carousel.
20. A method of inserting an object into a borehole in a mine passage, comprising:
    advancing a driver for driving the object into the borehole into engagement with a first arm of a gripper for causing the first arm to move from a deployed position in a direction away from the borehole to a withdrawn position.
21. The method of item 20, wherein the first arm is linked to a second arm, such that the method includes the step of concurrently moving the second arm from a deployed position to a withdrawn position.
22. The method of item 20, wherein the first arm is an upper arm, and the causing step causes the upper arm to move downwardly.

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional components), feature(s), characteristic(s), parameter(s), integer(s), step(s), or groups thereof. Each of these terms is considered equivalent in meaning to the phrase "consisting essentially of. Each of the phrases "consisting of and "consists of," as used herein, means "including and limited to."

The phrase "consisting essentially of," as used herein, means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic being a system unit system sub-unit device, assembly, sub-assembly, mechanism, structure, component or element or, peripheral equipment utility, accessory, or material, step or procedure, sub-step or sub-procedure, but only if each such additional feature or characteristic does not materially alter the basic novel and inventive characteristics or special technical features, of the claimed item.

The term "method," as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value. "Generally polygonal" means that the shape has flat surfaces, as with a polygon, but may have rounded corners connecting these surfaces.

The phrase "operatively connected," as used herein, equivalently refers to the corresponding synonymous phrases "operatively joined", and "operatively attached," where the operative connection, operative joint or operative attachment, is according to a physical, or/and electrical, or/and electronic, or/and mechanical, or/and electro-mechanical, manner or nature, involving various types and kinds of hardware or/and software equipment and components.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

The invention claimed is:

1. An apparatus for inserting an object into a borehole in a surface of a mine passage, comprising:

a driver adapted to advance toward the surface for driving the object into the borehole; and a gripper including a first arm and a second arm for gripping the object in a deployed position;

wherein the first arm and the second arm project from a first axis;

wherein the first arm is adapted to rotate relative to a second axis transverse to the first axis, and wherein the second arm is adapted to rotate relative to a third axis transverse to the first axis; and wherein the first arm and the second arm are linked such that engagement by one of the first and second arms with the driver during advance causes the first arm to rotate about the second axis from a first arm deployed position toward the second arm to a first arm retracted position and the second arm to rotate about the third axis from a second arm deployed position toward the first arm to a second arm retracted position.

2. The apparatus of claim 1, wherein the first and second arms are linked by a linkage.

3. The apparatus of claim 1, wherein each of the first and second arms includes a pair of jaws.

4. The apparatus of claim 1, wherein the driver is mounted for movement along a mast connected to a drill module to which the gripper is mounted, and wherein the drill module is mounted for moving the driver from a home position into alignment with the borehole, and further including a stop in a return path for engaging one of the first and second arms to cause rotation.

5. The apparatus of claim 1, further including a spring for biasing one of the first or second arms toward the deployed position.

6. The apparatus of claim 1, further including a magazine for holding a plurality of the objects in a position for being gripped by the gripper.

7. The apparatus of claim 6, wherein the magazine comprises a rotary carousel.

8. The apparatus of claim 1, wherein the first axis is a vertical axis, and wherein the first arm comprises an upper arm adapted for pivoting downwardly during retraction and the second arm comprises a lower arm adapted for pivoting upwardly during retraction.

9. An apparatus for assisting in inserting an object into a borehole in a surface of a mine passage, comprising:

a gripper including a first arm having jaws for gripping the object in a deployed position, the at least one arm adapted to rotate about a first axis so as to move away from the surface to a retracted position;

a second arm adapted to move toward the surface from the deployed position to the retracted position; and a linkage linking the first arm and the second arm, said linkage adapted to cause the first arm and the second arm to move in concert.

10. The apparatus of claim 9, wherein each of the first and second arms includes a pair of jaws.

11. The apparatus of claim 9, further including a driver adapted to advance toward the surface such that engagement between the second arm and the driver during the advance causes the first and second arms to move to the retracted position.

12. The apparatus of claim 9, further including a spring for biasing one of the first or second arms toward the deployed position.

13. The apparatus of claim 9, wherein a driver is mounted for movement along a mast connected to a drill module to which the gripper is mounted, and wherein the drill module is mounted for moving the driver from a home position into alignment with the borehole, and further including a stop in a return path for engaging one of the first and second arms to cause retraction.

14. The apparatus of claim 9, further including a magazine for holding one or more of the objects in a position for being gripped by the gripper.

15. The apparatus of claim 14, wherein the magazine comprises a rotary carousel.

16. A method of inserting an object into a borehole in a surface of a mine passage, comprising:

advancing a driver for driving the object into the borehole into engagement with a first arm of a gripper for causing the first arm to move from a deployed position in a direction away from the surface to a withdrawn position;

wherein the first arm is linked to a second arm, such that moving the first arm from the deployed position to the withdrawn position concurrently causes moving of the second arm from a deployed position to a withdrawn position.

17. The method of claim 16, wherein the first arm is an upper arm, and the causing step causes the upper arm to move downwardly.

* * * * *